US005957010A

United States Patent [19]

Petts

[11] Patent Number: 5,957,010

[45] Date of Patent: Sep. 28, 1999

[54] WRENCH APPARATUS

[76] Inventor: Andax Petts, 37 Tulloch Street, Planlands Qld 4740, Australia

[21] Appl. No.: 08/952,085

[22] PCT Filed: May 13, 1996

[86] PCT No.: PCT/AU96/00291

§ 371 Date: Dec. 30, 1997

§ 102(e) Date: Dec. 30, 1997

[87] PCT Pub. No.: WO96/35553

PCT Pub. Date: Nov. 14, 1996

[30] Foreign Application Priority Data

May 11, 1995 [AU] Australia ..... PN2934

[51] Int. Cl.[6] ..... B25B 13/28

[52] U.S. Cl. ..... 81/111; 87/90.3; 87/91.2

[58] Field of Search ..... 81/90.3, 91.2, 81/111

[56] References Cited

U.S. PATENT DOCUMENTS

| | | | |
|---|---|---|---|
| 615,643 | 12/1898 | Strahle | 81/91.2 X |
| 1,569,148 | 1/1926 | Stainbrook | 81/90.3 |
| 2,694,331 | 11/1954 | Meredith | 81/91.2 X |
| 5,427,004 | 6/1995 | Monaco | 81/91.2 X |

FOREIGN PATENT DOCUMENTS

| | | |
|---|---|---|
| 601486 | 3/1926 | France . |
| 2259292 | 6/1974 | Germany . |
| 653557 | 5/1951 | United Kingdom . |

*Primary Examiner*—James G. Smith

[57] ABSTRACT

Wrench apparatus for rotating a body about an axis and including a jaw assembly having opposed jaw members, a lever assembly having lever means pivotally connected to one jaw member, and abutment means associated with an inner portion of the lever means and cooperable with the opposing jaw member for urging the jaw assembly into tight engagement with the body to be rotated upon rotation of the lever assembly about the axis of the body. The abutment means is adjustably engageable with the lever means whereby the operative position of the lever means relative to the jaw assembly may be selectively varied. The abutment means closes across the open end of the jaw assembly and is moveable independently of the lever assembly between an engage closing position and an open position at which the jaw assembly can be accessed through its open end. At least one, but preferably both jaw members include an engagement portion for engagement with the object and the engagement portion is preferably arranged in internally arcuate toothed portions. A ratchet and pawl assembly are preferably interposed between the lever means and the abutment means to selectively vary the operative position of the lever means by selectively engaging the pawl with the ratchet.

5 Claims, 4 Drawing Sheets

WRENCH APPARATUS

This invention relates to wrench apparatus.

This invention has particular but not exclusive application to wrench apparatus for applying torque to shafts such as drive shafts, bolt stems or drill strings or the like and for illustrative purposes reference will be made to such application. However, it is to be understood that this invention could be used in other applications where an application of torque is required for objects resisting torsion.

In drilling apparatus and such like, drill heads and other apparatus connected to the end of drill rods frequently become tightly engaged by a threaded connection. Pipe wrenches (often referred to by the trade name Stillson) or chain tongs or chain vises (often referred to by the trade name Petol wrench) may be used to disengage such connections. Because a pipe wrench has a limited contact with the object to which torque is to be applied, the pipe wrench may slip or may damage the surface of the article.

Where chain tongs are used, the chain or the bolt connecting the chain to the jaw or jaws of the chain tongs may break causing damage to equipment or injury to a user. Additionally, pipe wrenches or chain tongs are not readily adaptable for remote operation such as by being powered by a hydraulic ram.

The present invention aims to alleviate one or more of the above disadvantages and to provide wrench apparatus which will be reliable and efficient in use.

With the foregoing in view, this invention in one aspect resides broadly in wrench apparatus for rotating a body about an axis and including:

a jaw assembly having opposed jaw members;

a lever assembly having lever means pivotally connected to one jaw member and abutment means associated with an inner portion of the lever means and cooperable with the opposing jaw member for urging the jaw assembly into tight engagement with the body to be rotated upon rotation of the lever assembly about the axis of the body, wherein the abutment means is adjustably engageable with the lever means whereby the operative position of the lever means relative to the jaw assembly may be selectively varied.

In a preferred embodiment of the invention the abutment means provides a closure across the open end of the jaw assembly and is moveable independently of the lever assembly between an engaged closing position and an open position at which the jaw assembly can be accessed through its open end.

At least one, but preferably both of the jaw members preferably include an engagement portion for engagement with the object, and the engagement portion is preferably arranged in internally arcuate toothed portions provided on each of the first and second hinged portions respectively. Preferably, the arcuate portions are provided as removable toothed sections, or the internal portion of the first and second hinged portions may be formed with a toothed surface about the inner circumference. Where removable toothed sections are provided, two or more sets of toothed sections may be provided having a different cross-sectional profile or tooth pattern to permit the wrench apparatus to be used in more than one application.

Preferably, a ratchet and pawl assembly is provided between the lever means and the abutment means whereby the operative position of the lever means may be selectively varied by selectively engaging the pawl with the ratchet. The ratchet and pawl assembly are so formed and arranged that operation of the handle means operates the ratchet and pawl assembly to tighten the jaw members by engagement of the lever means against the abutment portion.

It is also preferred that the abutment means is in the form of a catch which hooks about the opposing jaw member for secure engagement therewith.

Additionally, the lever assembly preferably includes a distal end remote from the object a distance sufficient to permit a linear force applied thereto to provide a mechanical advantage in applying a torque sufficient to rotationally move the object.

In a further aspect, this invention resides in a method of applying torque to an object, said method including:

providing wrench apparatus having a jaw assembly with opposed jaw members, a lever assembly having lever means pivotally connected to one jaw member and abutment means associated with an inner portion of the lever means and cooperable with the opposing jaw member;

selectively varying the operative position of the lever means relative to the jaw assembly; placing the object within the jaw assembly for engagement therewith;

operating the lever means to tighten the jaw means to a closed position about the object and apply torque thereto by urging the lever means against the abutment means, and rotating the body to be rotated.

In order that this invention may be more readily understood and put into practical effect, reference will now be made to the accompanying drawings which illustrate one or more preferred embodiments of the invention and wherein:

FIGS. 1 to 3 collectively show an orthographic projection of a wrench apparatus of this invention;

Figures 1, 2, 3:
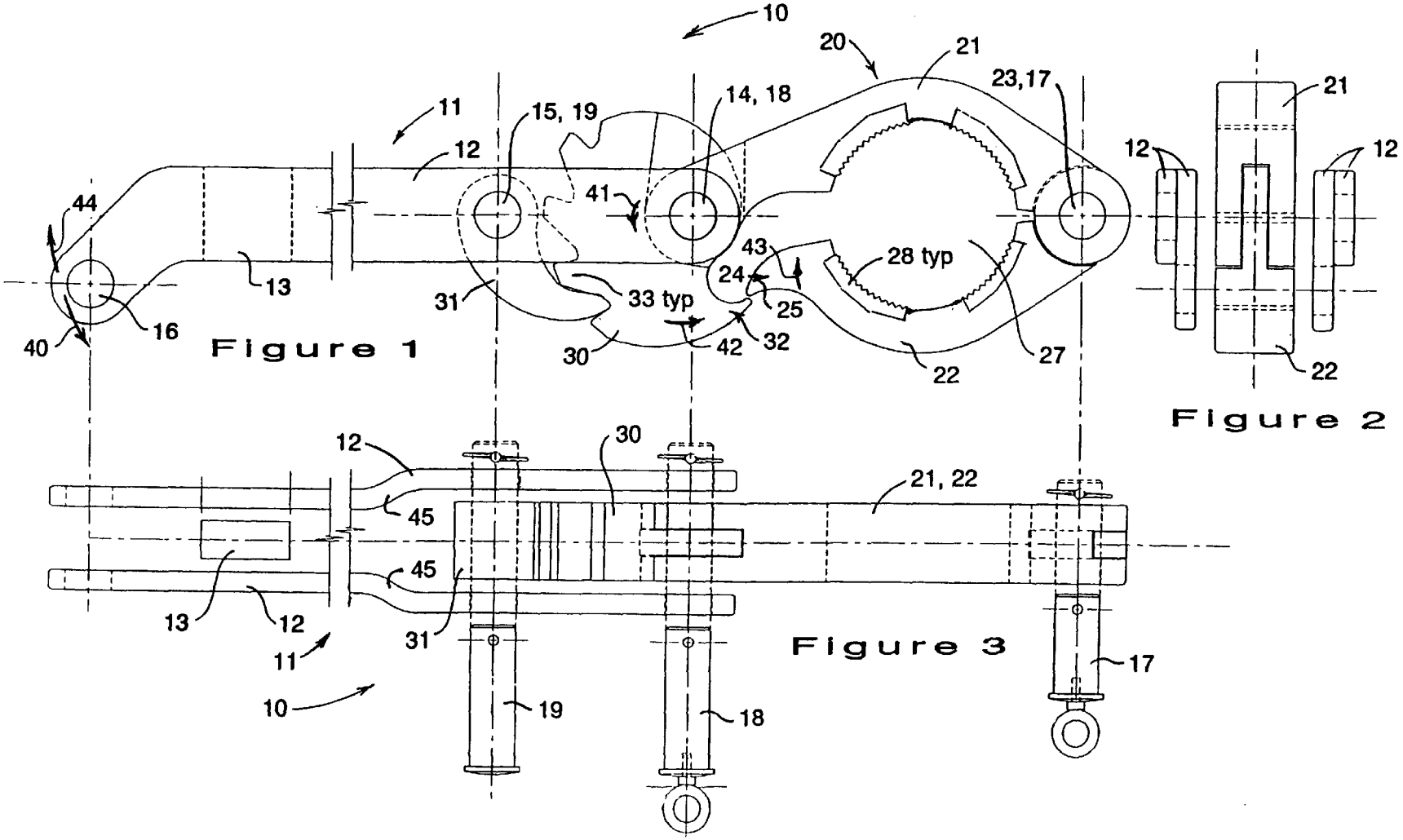
Figure 4:
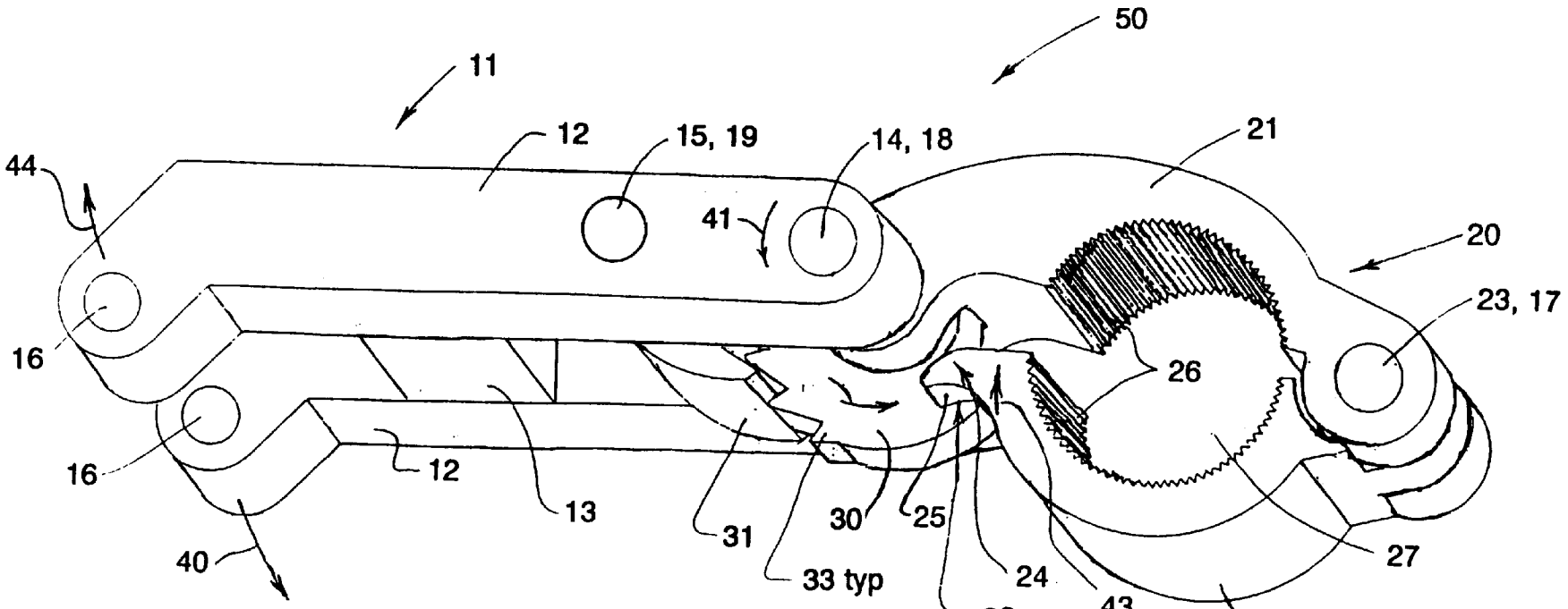
FIG. 4 shows an alternative wrench apparatus of this invention.
Figure 5:
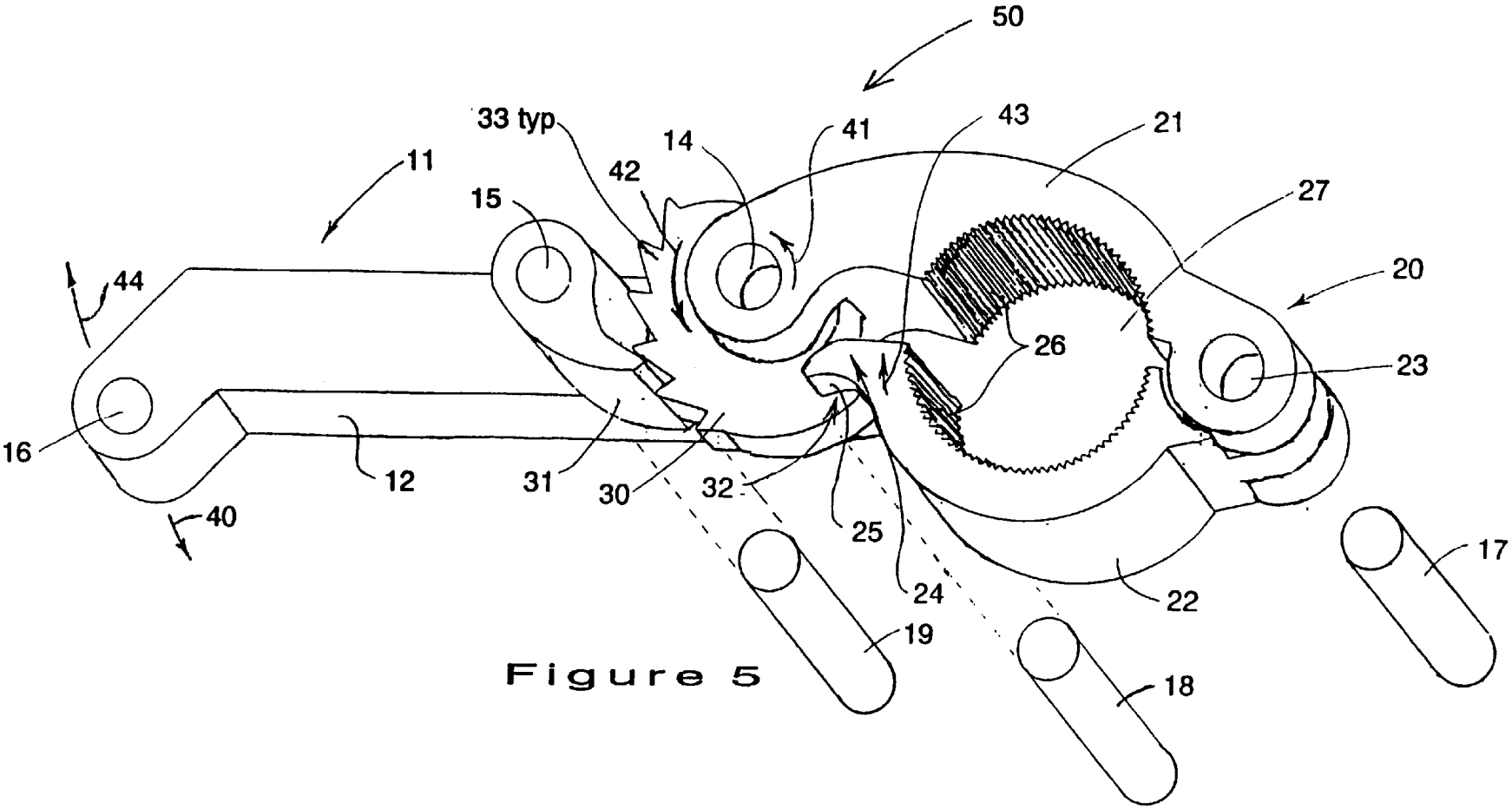
FIG. 5 shows the alternative wrench apparatus of FIG. 4 with part of the handle removed to show the working parts of the wrench apparatus.
Figure 6:
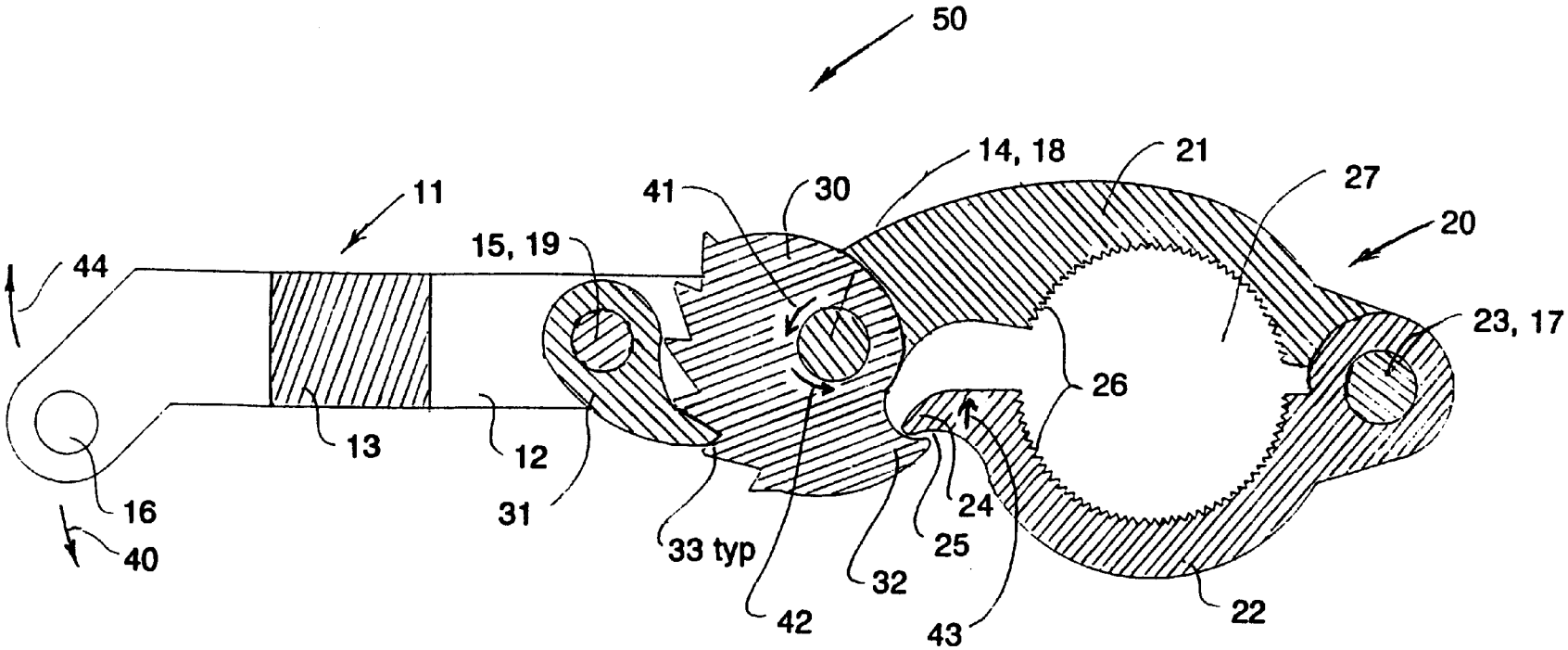
FIG. 6 shows a bisecting sectional view of the wrench apparatus of FIGS. 4 and 5.

In the FIGS. 1 to 6, like parts are given the same reference numerals, a wrench apparatus 10 being shown in FIGS. 1 to 3, and an alternative wrench apparatus 50 being shown in FIGS. 4 to 6.

Referring to FIGS. 1 to 6, the wrench apparatus 10, and the alternative wrench apparatus 50 each include a handle assembly 11 having two identical handle portions 12, one of which has been removed from FIG. 5 to show the workings of the alternative wrench apparatus 50. The handle assembly 11 also includes a spacer block 13 welded to at least one of the handle portions.

The wrench apparatus 10 and the alternative wrench apparatus 50 each also include a clamp assembly 20 having a primary jaw member 21 pivotally connected to the handle assembly 11 at one end and a secondary jaw member 22 pivotally connected to the primary jaw member 21 at the other end. The primary and secondary jaw members 21 and 22, when put together, make a substantially complete circular aperture 27.

In the embodiment shown in FIGS. 1 to 3, the circular aperture 27 includes four removable gripping elements shown typically at 28, each of which includes a gripping surface 29. In the embodiment shown in FIGS. 4 to 6, the circular aperture 27 includes a substantially circular gripping surface 26 formed about the inner periphery of the primary and secondary jaw members 21 and 22.

The wrench apparatus 10 also includes a ratchet member 30 and a pawl member 31 mounted between the handle portions 12, and each handle portion 12 includes a proximal aperture 14, a central aperture 15 and a distal aperture 16. The proximal aperture 14 receives a lever pin 18 to pass through the primary jaw member 21, the ratchet member 30 and each handle portion 12 so that each respective part is pivoted about a common axis. The central aperture 15 receives a pawl pin 19 which passes through the pawl member 31 and each handle portion 12 to permit operative rotation of the pawl member 31 about the pawl pin 19.

The distal apertures 16 in each handle portion 12 receive a pin (not shown) to permit the handle assembly 11 to be operatively connected to drive means for remote operation.

The primary jaw member 21 and secondary jaw member 22 also include a hinge aperture 23 passing through each respective member to form a hinge about which the secondary jaw member 22 may pivot with respect to the primary jaw member 21. The hinge aperture receives a hinge pin 17 about which the primary jaw member 21 and secondary jaw member 22 pivot.

The secondary jaw member 22 also includes a tongue portion 24 remote from the hinge aperture 23. The tongue portion 24 is shaped so as to form a bearing surface 25 with which a complementary latch portion 32 on the ratchet member 30 may engage.

The ratchet member 30 has a plurality of teeth, shown typically at 33, against which the pawl member 31 may bears to pivot the ratchet member 30 causing the complementary latch portion 32 to bear upon the bearing surface 25 and thus force the secondary jaw member 22 towards the primary jaw member 21. This causes the gripping surface 26 on the internal surfaces the primary and secondary jaw members 21 and 22 to grip against an object (not shown) to which torque is to be applied by the wrench apparatus 10 or the alternative wrench apparatus 50.

Thus, a force applied to the distal end of the handle assembly 11 in the direction of an arrow 40 induces rotation of the handle assembly 11 about the proximal aperture 14 in the direction of an arrow 41, thus urging the ratchet member 30 to rotate in the direction of an arrow 42, causing the complementary latch portion 32 to be urged against the bearing surface 25 forcing the tongue portion 24 of the secondary jaw member 22 to be urged in the direction of an arrow 43 towards the primary jaw member 21.

Release of the force in the direction of the arrow 40 permits the handle assembly 11 to move in the direction of an arrow 44 to allow the pawl member 31 to be released from a respective tooth 33 and be re-positioned against another tooth 33 behind that against which it was formerly engaged and thus permit the force at the distal end of the handle assembly 11 in the direction of the arrow 40 to be reapplied.

Additionally, rotation of the distal portion of the handle assembly 11 in the direction of the arrow 44 and in the opposite direction of the arrow 41 at the proximal aperture 14 permits the ratchet member 30 to be disengaged from having its complementary latch portion 32 bear against the bearing surface 25 and thus permit the tongue portion 24 to pass over the complementary latch portion 32 and the secondary jaw member 22 to open completely away from the primary jaw member 21 to release the wrench apparatus 10 or the alternative wrench apparatus 50 from the object about which it was engaged.

The wrench apparatus 10 preferably comprises twelve parts, being five principle parts, the three pins 17, 18 and 19 and the four replaceable gripping elements 28. The alternative wrench apparatus 50 preferably comprises eight parts, being five principle parts and three pins. Two of the principle parts consist of the primary and secondary jaw members 21 and 22 as described above and which, when put together, substantially complete the circular aperture 27.

The handle portions 12 shown in the wrench apparatus 10 of FIGS. 1 to 3 include a bend at 45 to bring the handle portions closer together remote from the pawl member 31. The handle portions 12 shown in respect of the alterative wrench apparatus 50 of FIGS. 4 to 6 are substantially straight, the spacer block 13 being widened to extend between the handle portions 12 as shown.

The primary jaw member 21 is grooved out and the secondary jaw member 22 is cut away, so that the secondary jaw member 22 fits inside the primary jaw member 21, each pivotally joined by the hinge pin 17. The end of the primary jaw member 21 opposite from where it is pivotally connected to the secondary jaw member 22 is also grooved out for receiving the ratchet member 30. The ratchet member 30 and the complementary latch portion 32 are preferably of the same thickness of material as the cut out portion of the secondary jaw member 22. It is believed that this arrangement minimises bending forces on the respective pins providing the pivotal connections, since the parts are substantially operatively aligned in a plane substantially normal to the axis of the object to which torque is to be applied.

The ratchet member 30 has several large teeth cut into it at an angle of 20° from the radius, but apart from the teeth, the remainder of the ratchet is of non-constant radius.

In use, the wrench assembly may be placed around an object to be rotated. When the handle is moved backwards, the pawl moves back with it and is able to move freely and drop into each tooth on the ratchet piece and upon being urged in the forward direction, the jaw members are clamped together around the object with a force magnified by the mechanical advantage of the pawl on the ratchet piece and the complementary latch portion on the tongue of the secondary jaw member.

It is preferred that the shape of the ratchet tongue and the tongue of the half circular piece are so formed and arranged that the mechanical advantage is increased as the grip is tightened.

It will of course be realised that while the above has been given by way of illustrative example of this invention, all such and other modifications and variations thereto as would be apparent to persons skilled in the art are deemed to fall within the broad scope and ambit of this invention as claimed in the following claims.

I claim:

1. Wrench apparatus for rotating a body about an axis and including:

a jaw assembly having opposed jaw members pivotally connected to one another;

a lever assembly having lever means pivotally connected to one jaw member and abutment means associated with an inner portion of said lever means and cooperable with the opposing other said jaw member for urging said jaw assembly into tight engagement with the body to be rotated, upon rotation of said lever assembly about the axis of the body; and wherein said abutment means is adjustably engageable with said lever means whereby an operative position of the lever means relative to the jaw assembly may be selectively varied.

2. Wrench apparatus as claimed in claim 1, wherein said abutment means provides a closure across an open end of said jaw assembly and is moveable independently of said lever assembly between an engaged closing position and an open position at which said jaw assembly can be accessed through its open end.

3. Wrench apparatus as claimed in claim 1, wherein both said jaw members include an engagement portion for engagement with the body, said engagement portion being arranged in two internally arcuate toothed portions provided respectively on each said jaw member.

4. Wrench apparatus as claimed in claim 1, wherein said abutment means comprises a ratchet and pawl assembly whereby the operative position of said lever means may be selectively varied by selectively engaging said pawl with said ratchet.

5. Wrench apparatus as claimed in claim 4, wherein said ratchet and pawl assembly is so formed and arranged that operation of said handle means operates said ratchet and pawl assembly to tighten said jaw members by engagement of said lever means against said abutment portion.

* * * * *